US011731232B2

(12) United States Patent
Chen et al.

(10) Patent No.: US 11,731,232 B2
(45) Date of Patent: Aug. 22, 2023

(54) IRREGULAR MECHANICAL MOTION DETECTION SYSTEMS AND METHOD

(71) Applicant: Taiwan Semiconductor Manufacturing Co., Ltd., Hsinchu (TW)

(72) Inventors: Chunhung Chen, Youngjing (TW); Yu Chi Tsai, Hsinchu (TW); Chin Wei Chuang, Taichung (TW); Bo-An Chen, Hsinchu (TW); Sheng-Chen Wang, Taichung (TW); Chen-Hua Tsai, Hsinchu (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 1022 days.

(21) Appl. No.: 16/431,957

(22) Filed: Jun. 5, 2019

(65) Prior Publication Data

US 2020/0130130 A1 Apr. 30, 2020

Related U.S. Application Data

(60) Provisional application No. 62/752,598, filed on Oct. 30, 2018.

(51) Int. Cl.
*B24B 37/005* (2012.01)

(52) U.S. Cl.
CPC ..... *B24B 37/005* (2013.01)

(58) Field of Classification Search
CPC ... B24B 7/228; B24B 37/005; B24B 37/0053; B24B 37/04; B24B 37/042; B24B 37/046; B24B 37/07; B24B 37/10; B24B 37/105; B24B 37/107; B24B 37/34; B24B 49/00; B24B 49/003; B24B 49/006; B24B 49/08; B24B 49/10; B24B 49/105; B24B 49/12; B24B 49/16; B24B 49/18; B24B 49/183
See application file for complete search history.

(56) References Cited

U.S. PATENT DOCUMENTS

| | | | |
|---|---|---|---|
| 2003/0045009 A1 | 3/2003 | Tanaka et al. | |
| 2006/0063383 A1 | 3/2006 | Pattengale | |
| 2010/0035525 A1* | 2/2010 | Deshpande | B24B 37/005 451/443 |
| 2012/0088439 A1 | 4/2012 | Duescher | |

(Continued)

FOREIGN PATENT DOCUMENTS

| | | |
|---|---|---|
| CN | 1345084 A | 4/2002 |
| CN | 1314096 C | 5/2007 |

(Continued)

*Primary Examiner* — Joel D Crandall
(74) *Attorney, Agent, or Firm* — Seed IP Law Group LLP

(57) ABSTRACT

Systems and methods are provided for predicting irregular motions of one or more mechanical components of a semiconductor processing apparatus. A mechanical motion irregular prediction system includes one or more motion sensors that sense motion-related parameters associated with at least one mechanical component of a semiconductor processing apparatus. The one or more motion sensors output sensing signals based on the sensed motion-related parameters. Defect prediction circuitry predicts an irregular motion of the at least one mechanical component based on the sensing signals.

20 Claims, 6 Drawing Sheets

(56) References Cited

U.S. PATENT DOCUMENTS

| | | | | |
|---|---|---|---|---|
| 2013/0260646 | A1 | 10/2013 | Lischka et al. | |
| 2014/0134924 | A1* | 5/2014 | Shinozaki | B24B 37/30 451/5 |
| 2017/0190020 | A1* | 7/2017 | Kobayashi | B24B 49/04 |
| 2018/0071889 | A1 | 3/2018 | Huang et al. | |

FOREIGN PATENT DOCUMENTS

| | | | | |
|---|---|---|---|---|
| CN | 100380103 | C | 4/2008 | |
| CN | 102956521 | A | 3/2013 | |
| CN | 105571638 | A | 5/2016 | |
| CN | 105881194 | A | 8/2016 | |
| CN | 106463381 | A | 2/2017 | |
| CN | 106652999 | A | 5/2017 | |
| TW | 200915407 | A | 4/2009 | |
| WO | 2010/017000 | A2 | 2/2010 | |
| WO | WO-2018074091 | A1 * | 4/2018 | B24B 37/005 |

* cited by examiner

IRREGULAR MECHANICAL MOTION DETECTION SYSTEMS AND METHOD

BACKGROUND

During fabrication of semiconductor devices, semiconductor wafers are processed by a variety of mechanical apparatuses. As an example, during a chemical-mechanical planarization (CMP) process, a CMP apparatus may be utilized to process a wafer. The CMP apparatus may include a plurality of moving or movable components (e.g., a rotatable platen, a polishing head, a pad conditioner, and slurry sprinkler) which operate in coordination with one another to process the wafer.

Many semiconductor processes require very precise movements and positioning of the mechanical components. Even very small deviations from the correct positioning and movements of the components can result in defects in the semiconductor wafer that is undergoing processing.

BRIEF DESCRIPTION OF THE SEVERAL VIEWS OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
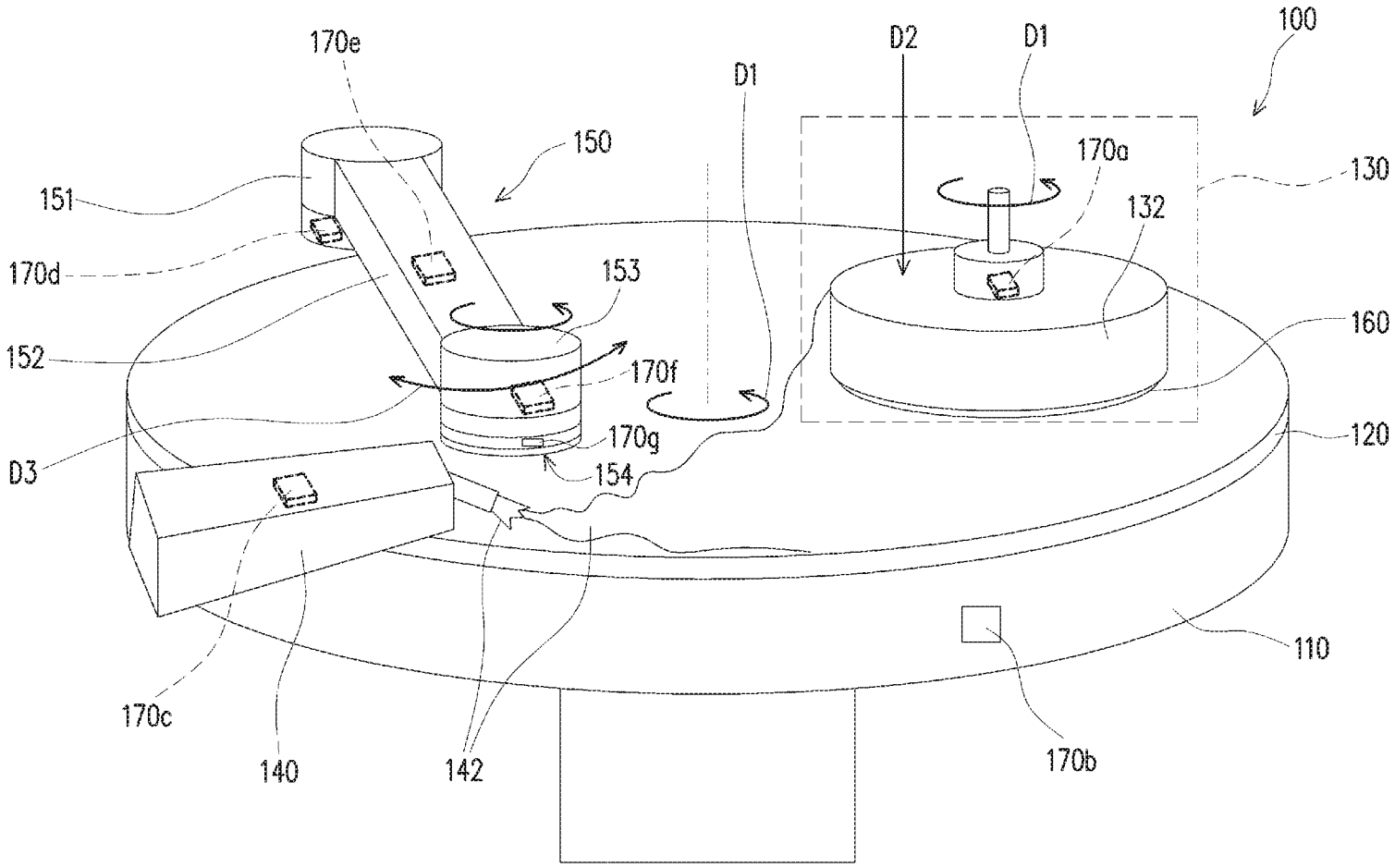
FIG. 1 is a perspective view schematically illustrating a chemical-mechanical polishing (CMP) apparatus, in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

In various embodiments, the present disclosure provides systems, apparatuses, and methods in which an irregular mechanical motion of a component (such as a component of a CMP apparatus) may be recognized or determined during operation.

Embodiments provided herein include mechanical motion irregularity prediction systems and methods for predicting an irregular motion of one or more mechanical components in a semiconductor processing apparatus based on sensed signals associated with one or more motion-related parameters associated with the one or more mechanical components. In some embodiments, spectral images are generated based on the sensed signals, and the spectral images include frequency and time information associated with the sensed signals. Machine learning techniques may be utilized to analyze the spectral images, which analysis may be based at least in part on historical spectral images stored in a spectral image database.

In various embodiments, the irregular motions of one or more components of a semiconductor processing apparatus may be predicted during operation of the apparatus, for example, while processing a semiconductor wafer. The one or more components of the semiconductor processing apparatus may be automatically stopped based on the predicted irregular motions, thereby preventing or reducing any damage from occurring to the semiconductor wafer being processed.

FIG. 1 is a perspective view schematically illustrating a chemical-mechanical polishing (CMP) apparatus 100, in accordance with one or more embodiments of the present disclosure. The CMP apparatus 100 may include a rotatable platen 110, a polishing pad 120, a polishing head 130, a slurry dispenser 140, and a pad conditioner 150. The polishing pad 120 is arranged on the platen 110. The slurry dispenser 140, the polishing head 130, and the pad conditioner 150 may be positioned above the polishing pad 120.

The polishing pad 120 may be attached to the platen 110, for example, the polishing pad 120 may be secured to an upper surface of the platen 110. The polishing pad 120 may be formed of any material that is hard enough to allow the abrasive particles in the slurry 142 to mechanically polish the wafer 160, which is operably positioned at a polishing location between the polishing head 130 and the polishing pad 120. On the other hand, polishing pad 120 is soft enough so that it does not substantially scratch the wafer 160 during the polishing process. The polishing pad 120 may be made of polyurethane or any other suitable materials.

During the CMP process, the platen 110 rotates along a direction of rotation D1 at any of various suitable speeds. For example, the platen 110 may be rotated along the direction of rotation D1 by any mechanism, such as a motor, or the like, which in turn rotates the polishing pad 120 in the direction of rotation D1. The polishing head 130 may apply a force along a direction D2 which pushes the wafer 160 in the direction D2 downward toward and against the polishing pad 120, such that a surface of the wafer 160 in contact with the polishing pad 120 may be polished by the slurry 142.

The polishing head 130 may include a wafer carrier 132 that positions the wafer 160 on the polishing pad 120 at the polishing location. For example, the wafer 160 may be disposed underneath the wafer carrier 132 and may be brought into contact with the polishing pad 120.

For further planarization of the wafer 160, the polishing head 130 may rotate (e.g., in the direction D1, as shown or the reverse direction), causing the wafer 160 to rotate, and move on the polishing pad 120 at the same time, but various embodiments of the present disclosure are not limited in this regard. The wafer carrier 132 may be securely attached to the polishing head 130 and the wafer carrier 132 may rotate along with the polishing head 130. In some embodiments, as shown in FIG. 1, the polishing head 130 and polishing pad 120 rotate in the same direction (e.g., clockwise or counterclockwise). In some alternative embodiments, the polishing head 130 and polishing pad 120 rotate in opposite directions.

While the CMP apparatus 100 is in operation, slurry 142 flows between the wafer 160 and the polishing pad 120. The slurry dispenser 140, which has an outlet over the polishing pad 120, is used to dispense the slurry 142 onto the polishing pad 120. The slurry 142 includes reactive chemicals that react with the surface layer of the wafer 160 and abrasive particles for mechanically polishing the surface of the wafer 160. Through the chemical reaction between the reactive chemicals in the slurry and the surface layer of the wafer 160, and the mechanical polishing, at least some of the surface layer of the wafer 160 is removed.

As the polishing pad 120 is used, the polishing surface tends to glaze, which can reduce the removal rate and overall efficiency of the CMP apparatus 100. The pad conditioner 150 is arranged over polishing pad 120, and is used to condition the polishing pad 120 and to remove undesirable by-products generated during the CMP process.

The pad conditioner 150 may include a pad conditioner base 151, a pad conditioner arm 152, and a pad conditioner head 153. The pad conditioner base 151 may be any base structure, or may be secured to any base structure, and may generally be fixed in its position. The pad conditioner arm 152 may be attached to the pad conditioner base 151, and the pad conditioner head 153 may be attached to an end of the pad conditioner arm 152 that is opposite the pad conditioner base 151. The pad conditioner arm 152 may be rotatable, for example, about a pivot or joint at which the pad conditioner arm 152 is connected to the pad conditioner base 151. For example, a mechanism such as a motor, actuator, or the like may be operatively coupled to the pad conditioner base 151 or the pad conditioner arm 152 and may be move the pad conditioner arm 152 and the attached pad conditioner head 153 such that the pad conditioner head 153 is movable along a third direction D3. The third direction D3 may be, for example, an arc or segment of an arc that may be defined by rotating the pad conditioner arm 152 and pad conditioner head 153 about a pivot point at which the pad conditioner arm 152 is attached to or otherwise rotatable about the pad conditioner base 151. The third direction D3 may represent travel of the pad conditioner head 153 along the arc in any direction, such as toward the left or toward the right as shown in FIG. 1.

A conditioning disk 154 is mechanically coupled to the pad conditioner head 153. For example, the conditioning disk 154 may be attached to the pad conditioner head 153. The conditioning disk 154 may extend outwardly from (e.g., in a downward direction) the pad conditioner head 153, such that the conditioning disk 154 may be brought into contact with the top surface of the polishing pad 120 when the polishing pad 120 is to be conditioned, for example, during use of the CMP apparatus 100. The conditioning disk 154 generally includes protrusions or cutting edges that can be used to polish and re-texturize the surface of the polishing pad 120. In some embodiments, the exposed surface (e.g., the lower surface) of the conditioning disk 154 is formed of or includes a diamond grit material which is used to condition the polishing pad 120. Such a conditioning disk may sometimes be referred to as a "diamond disk." In some embodiments, the conditioning disk 154 may be formed of other suitable materials such as scouring materials, bristles, or the like.

During the conditioning process, the polishing pad 120 and conditioning disk 154 are rotated, so that the protrusions, cutting edges, grit material, scouring material, or the like of the exposed lower surface of the conditioning disk 154 move relative to the surface of polishing pad 120, to polish the surface of the polishing pad 120. The conditioning disk 154 may be rotated along the first direction D1 of rotation, or in an opposite direction. For example, the conditioning disk 154 may be rotated in a clockwise direction or in a counterclockwise direction.

Any additional features or components may be included in the CMP apparatus 100, which may include, for example, any additional features or components of a CMP apparatus that may be known by those skilled in the field of semiconductor processing tools or CMP apparatuses. In some embodiments, one or more additional pad conditioners 150 may be included in the CMP apparatus 100, such that multiple conditioner disks may be utilized concurrently or alternately to polish the surface of the polishing pad 120. In some embodiments, the CMP apparatus 100 includes a pump (not shown), such as a pump for creating a vacuum or negative pressure between the wafer carrier 132 and the wafer 160 for securing the wafer 160 to the wafer carrier 132 during operation of the CMP apparatus 100. In some embodiments, the CMP apparatus 100 includes one or more motors (not shown), such as motors for moving any of the various components of the CMP apparatus 100 during use.

The CMP apparatus 100 includes one or more sensors 170, which may be positioned at various locations on or within various components of the CMP apparatus 100. For example, as shown in FIG. 1, the one or more sensors 170 may include any one or more of a first sensor 170*a* configured to sense one or more parameters associated with the polishing head 130, a second sensor 170*b* configured to sensor one or more parameters associated with the platen 110, a third sensor 170*c* configured to sense one or more parameters associated with the slurry dispenser 140, a fourth sensor 170*d* configured to sense one or more parameters associated with the pad conditioner base 151, a fifth sensor 170*e* configured to sense one or more parameters associated with the pad conditioner arm 152, a sixth sensor 170*f* configured to sense one or more parameters associated with the pad conditioner head 153, and a seventh sensor 170*g* configured to sense one or more parameters associated with the conditioning disk 154. In various embodiments, the one or more sensors 170 may be located on or within any component of the CMP apparatus 100, including, for example, on or in the polishing pad 120, on or in the wafer carrier 132, on or in a motor or a pump, or any other feature or component of a CMP apparatus. The one or more sensors 170 may be located on any of the components of the CMP apparatus 100, for example, by securing the sensors 170 to any portion of the components, such as an exterior portion of a housing or the like. The one or more sensors 170 may be located within any of the components of the CMP apparatus 100, for example, by securing the sensors 170 to an interior portion of the components, such as an interior of a housing or the like.

In some embodiments, the one or more sensors 170 are operable to sense motion-related parameters associated with the one or more components of the CMP apparatus. In some embodiments, the one or more sensors 170 may include any one or more of: a torque sensor, an acceleration sensor, a gyroscope, a vibration sensor, a pressure sensor, a temperature sensor, or a humidity sensor.

As will be discussed in further detail later herein, the various parameters associated with the components of the CMP apparatus 100 which are sensed by the one or more sensors 170 may be analyzed to detect irregularities in motion of the various components of the CMP apparatus 100. Irregular or abnormal motion of components of the CMP apparatus 100 can lead to undesirable effects of the processing of the wafer 160, such as various defects which may be result from over polishing or under polishing the wafer 160 due to the irregular motion of components of the CMP apparatus 100.

Figure 2:
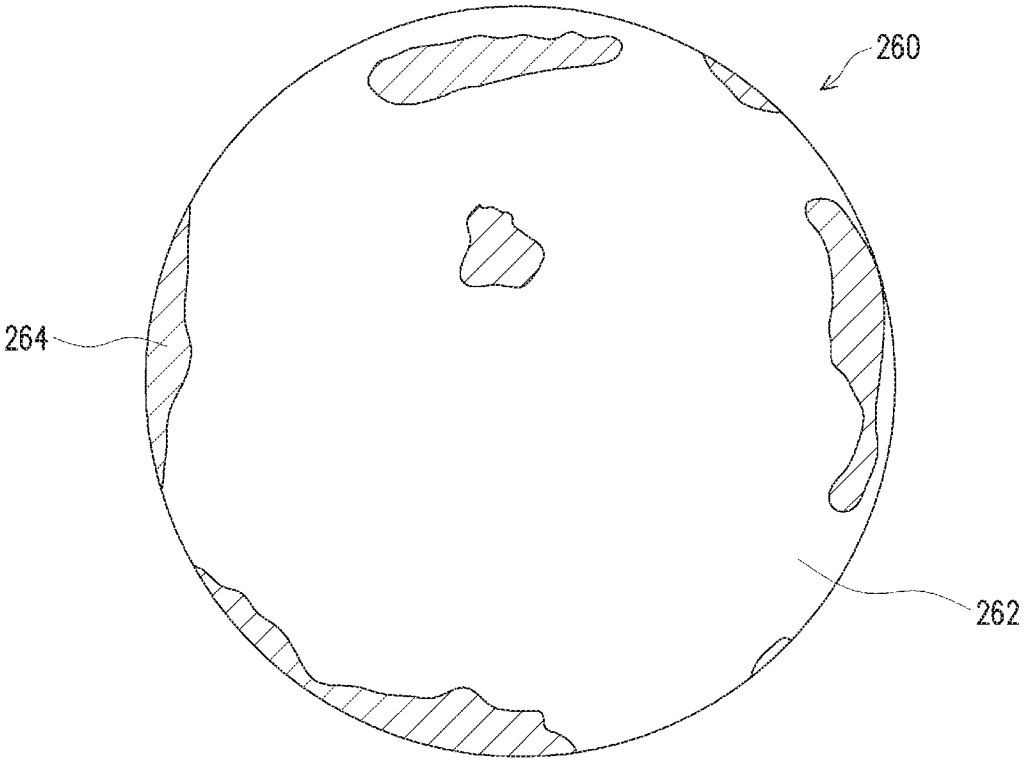
FIG. 2 is a schematic view showing a surface of a wafer having defects resulting from irregular motions of a CMP apparatus.

FIG. 2 is a schematic illustration showing a surface of a wafer having one or more defects resulting from a CMP process performed by a CMP apparatus in which one or more components exhibited irregular motions. As shown in FIG. 2, the surface of the wafer 260 includes one or more normal regions 262 and a plurality of abnormal regions 264 as a result of the processing, e.g., polishing, by the CMP apparatus. The abnormal regions 264 may be defective regions which may result in defects in the semiconductor devices (e.g., chips or the like) which are to be formed from the wafer 260. The abnormal regions 264 may result from, for example, over polishing of the surface of the wafer 260 by the CMP apparatus 100, and the over polishing may be caused by irregular motions of any of the components of the CMP apparatus 100, including, for example, the polishing head 130, the platen 110, the slurry dispenser 140, the pad conditioner base 151, the pad conditioner arm 152, the pad conditioner head 153, the conditioning disk 154, a motor, a pump, or any other component within the CMP apparatus 100.

Figure 3A:
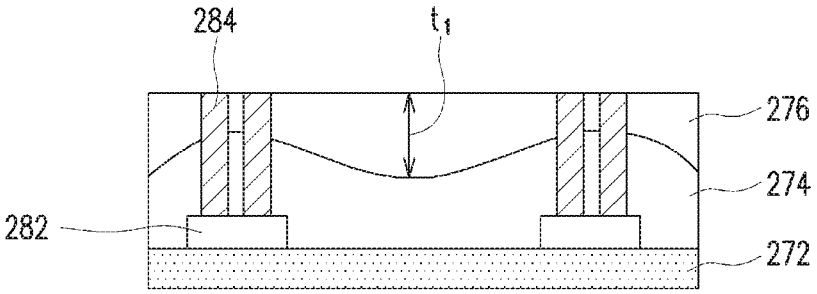
FIG. 3A is a cross-sectional view schematically illustrating features of a semiconductor wafer before processing in a CMP apparatus.
Figure 3B:
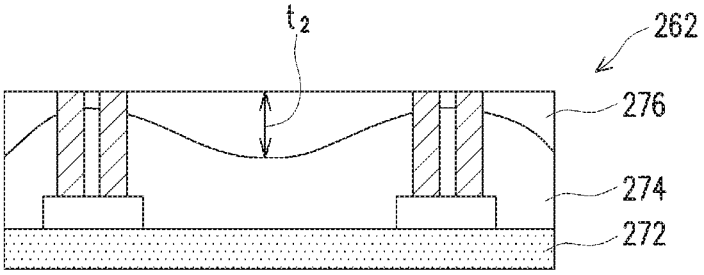
FIG. 3B is a cross-sectional view schematically illustrating a normal region of the wafer shown in FIG. 3A after processing in the CMP apparatus.
Figure 3C:
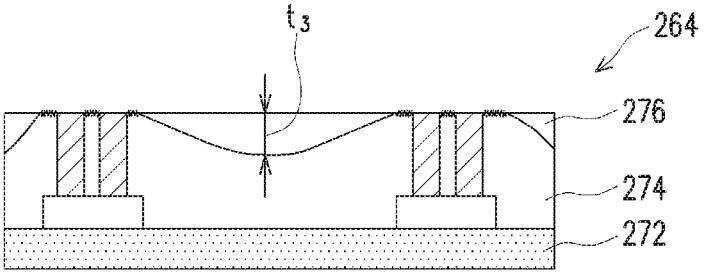
FIG. 3C is a cross-sectional view schematically illustrating an abnormal region of the wafer shown in FIG. 3A after processing in the CMP apparatus.

FIG. 3A is a cross-sectional view schematically illustrating features of the wafer 260 before processing in a CMP apparatus, FIG. 3B is a cross-sectional view schematically illustrating a normal region 262 of the wafer 260 after processing in the CMP apparatus, and FIG. 3C is a cross-sectional view schematically illustrating an abnormal region 264 of the wafer 260 after processing in the CMP apparatus.

As shown in FIG. 3A, the wafer 260 may include a variety of layers, features, or the like before processing in the CMP apparatus, e.g., before polishing a surface of the wafer 260. The wafer 260 may include any layers, features, or the like, as may be known to those skilled in the relevant field. In the example shown in FIG. 3A, the wafer 260 includes a substrate 272, which may be a semiconductor substrate of any suitable material for use in semiconductor device manufacturing. For example, the substrate 272 may be a silicon substrate; however, embodiments provided herein are not limited thereto. For example, in various embodiments, the substrate 272 may include gallium arsenide (GaAs), gallium nitride (GaN), silicon carbide (SiC), or any other semiconductor material. The substrate 272 may include various doping configurations depending upon design specifications.

A first layer 274 may be formed on the substrate 272, and the first layer 274 may be a layer of any material utilized in the manufacture of semiconductor devices. For example, in some embodiments, the first layer 274 may be a first dielectric layer; however, embodiments provided herein are not limited thereto. In various embodiments, the first layer 274 may be a conductive layer, a semiconductor layer, or any other layer of material.

A second layer 276 may be formed on the first layer 274, and the second layer 276 may be a layer of any material utilized in the manufacture of semiconductor devices. For example, in some embodiments, the second layer 276 may be a second dielectric layer; however, embodiments provided herein are not limited thereto. In various embodiments, the second layer 276 may be a conductive layer, a semiconductor layer, or any other layer of material.

One or more first electrical features 282 may be formed in the wafer 260, and the first electrical features 282 may be any electrical features formed in the manufacture of semiconductor devices. In the example shown in FIG. 3A, the first electrical features 282 may be formed on the substrate 272; however, embodiments provided herein are not limited thereto. In various embodiments, the first electrical features 282 may be formed within the substrate 272, in the first layer 274, in the second layer 276, or at any other location in the wafer 260. The first electrical features 282 may be, for example, any electrical component, such as a transistor, a capacitor, a resistor, a metal or conductive track or layer, or the like.

The wafer 260 may further include one or more second electrical features 284, which may be any electrical features formed in the manufacture of semiconductor devices. In the example shown in FIG. 3B, the second electrical features 284 may be formed to extend between an upper surface of the wafer 260 and the first electrical features 282; however, embodiments provided herein are not limited thereto. The second electrical features 284 may be, for example, conductive vias; however, in various embodiments, the second electrical features 284 may be any electrical component or feature.

Before polishing a surface (e.g., the upper surface) of the wafer 260, the wafer 260 has a certain thickness, which is later reduced due to the polishing. For example, as shown in FIG. 3A, the wafer 260 has a first thickness $t_1$ between the upper surface of the first layer 274 and the upper surface of the wafer 260. As shown in FIG. 3A, the upper surface of the first layer 274 may be uneven or undulating, and therefore a thickness between the upper surface of the first layer 274 and the upper surface of the wafer 260 may vary. For convenience of description, the first thickness $t_1$ is shown as being measured at a lowest point of the upper surface of the first layer 274 which forms a valley.

As shown in FIG. 3B, after polishing of the upper surface of the wafer 260, the second layer 276 is thinned by the polishing and portions of the second layer 276 are removed. Additionally, portions of the second electrical features 284 may be removed by the polishing. Accordingly, the wafer 260 has a second thickness $t_2$ between the upper surface of the first layer 274 and the upper surface of the wafer 260 after the polishing, and the second thickness $t_2$ is less than the first thickness $t_1$. FIG. 3B illustrates the normal region 262 of the wafer 260. Thus, FIG. 3B may represent an expected profile of the wafer 260 after a normal polishing process, i.e., in the absence of irregular motions of the components of the CMP apparatus. Even in the presence of irregular motions of one or more components of the CMP apparatus, one or more normal regions 262 of the wafer 260 may result from the processing, since such irregularities in motion may primarily affect certain portions or regions of the wafer 260, such as edge regions of the wafer 260. The normal regions 262 may be, for example, central regions of the wafer 260 which are unaffected by the irregular motions.

As shown in FIG. 3B, no part of the first layer 274 is exposed after the polishing in the expected profile of the wafer 260 or in the normal region 262.

In contrast, referring now to FIG. 3C, in the abnormal regions 264, portions of the first layer 274 may be exposed at the upper surface of the wafer 260 after the wafer 260 is polished. This may result in defects in the semiconductor devices (e.g., chips or the like) which are to be formed from the wafer 260. In the abnormal regions 264, the wafer 260 has a third thickness $t_3$ between the upper surface of the first layer 274 and the upper surface of the wafer 260 that is less than the second thickness $t_2$, which indicates over polishing of the wafer 260 in the abnormal regions 264. Moreover, as mentioned above, portions of the second layer 276 are completely removed in the abnormal regions 264, leaving portions of the first layer 274 exposed at the upper surface of the wafer 260.

Referring again to FIG. 1, by sensing motion-related parameters associated with the various components of the CMP apparatus 100 by the one or more sensors 170, and analyzing the sensed parameters, irregularities in motion of the various components of the CMP apparatus 100 may be detected, which facilitates remediation of the irregular motion, thereby preventing or reducing the occurrence of the abnormal regions 264 due to processing of waters in the CMP apparatus 100. Moreover, in some embodiments, a status of one or more of the components of the CMP apparatus 100 may be predicted or determined based on the analysis of the motion-related parameters, and in some embodiments, a remaining operational lifetime (or time until failure) of the one or more components may be predicted or determined based on the analysis of the motion-related parameters. For example, if the analysis of the motion-related parameters indicates abnormal mechanical motion of a component (e.g., a pad conditioner head, a conditioning disk, a pad conditioner arm, a pump, a motor, or the like of a CMP apparatus), then a status of the component may be determined (e.g., beginning to breakdown, but not yet outside of a particular tolerance range) and a remaining operational lifetime of the component may further be predicted or determined from an analysis of the motion-related parameters.

Figure 4:
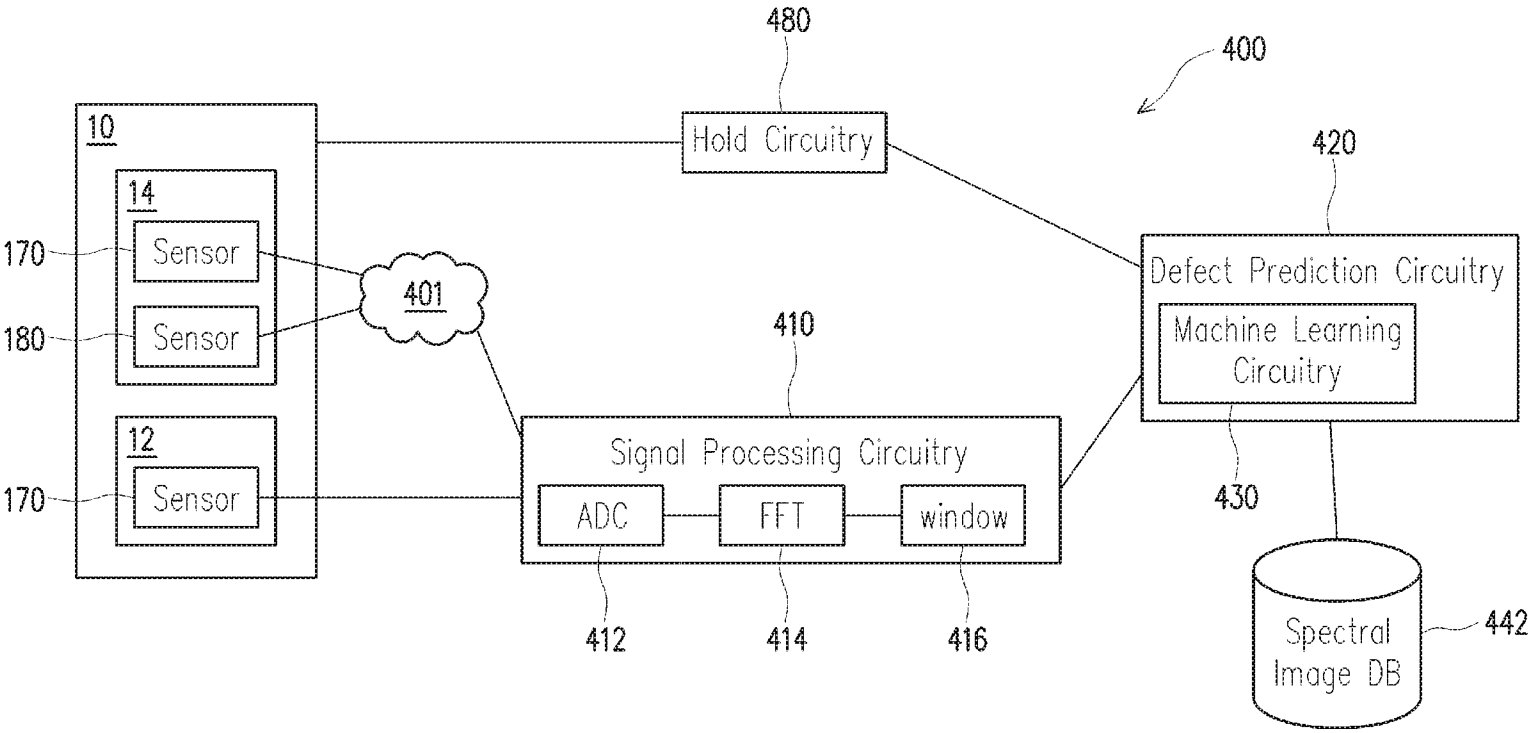
FIG. 4 is a block diagram illustrating an irregular mechanical motion detection system, in accordance with some embodiments.

FIG. 4 is a block diagram illustrating an irregular mechanical motion detection system 400, in accordance with embodiments of the present disclosure. The irregular mechanical motion detection system 400 may be used in conjunction with, and may include one or more of the features and functionality of, a semiconductor processing apparatus 10, which may be, for example, the CMP apparatus 100 shown in FIG. 1. However, embodiments provided by the present disclosure are not limited thereto. In various embodiments the semiconductor processing apparatus 10 may be any apparatus having one or more mechanical components that is used during a semiconductor device manufacturing process, including, for example, apparatuses for performing chemical vapor deposition (CVD), physical vapor deposition (PVD), etching, lithography, or any other semiconductor processing apparatus or tool. In some embodiments, the semiconductor processing apparatus 10 is included as part of the irregular mechanical motion detection system 400. The irregular mechanical motion detection system 400 may be utilized to detect irregularities in motion of any of the various components of the CMP apparatus 100, based on one or more motion-related parameters sensed by one or more sensors 170.

As shown in FIG. 4, the semiconductor processing apparatus 10 may include a first mechanical component 12 and a second mechanical component 14. The first and second mechanical components 12, 14 may be any mechanical components of a semiconductor processing apparatus, including, for example, any of the polishing head 130, the platen 110, the slurry dispenser 140, the pad conditioner base 151, the pad conditioner arm 152, the pad conditioner head 153, the conditioning disk 154, a motor, a pump, or any other component of the CMP apparatus 100.

The sensors 170 may be located on or within the first and second mechanical components 12, 14 and configured to sense one or more motion-related parameters associated with the first and second mechanical components 12, 14. In various embodiments, the sensors 170 may be any of the sensors 170*a*-170*g* illustrated in FIG. 1, and may be any of a torque sensor, an acceleration sensor, a gyroscope, a vibration sensor, or any other motion-related sensor. In some embodiments, one or more additional sensors 180 may be included in the apparatus 10, and such additional sensors may sense any additional parameters associated with the first or second mechanical components 12, 14, including, for example, a pressure sensor, a temperature sensor, or a humidity sensor. Although the additional sensors 180 may not directly sense motion of the mechanical components, the parameters sensed by the additional sensors 180 may be related to an irregular motion of the component. For example, a temperature sensor senses temperature; however, the temperature of certain components (e.g., the platen 110) may be associated with irregular motions of the components, since the temperature may affect motion-related parameters such as a speed of rotation, or the like. Moreover, the parameters sensed by the additional sensors 180 may be associated with defective operating conditions of the mechanical components, and may provide useful information regarding a predicted operational lifetime of the mechanical components.

The semiconductor processing apparatus 10 is shown in FIG. 4 as including just two mechanical components, two sensors 170, and one additional sensor 180; however, embodiments of the present disclosure are not limited thereto. In various embodiments, the semiconductor processing apparatus 10 may include any number of motion-related sensors 170 and any number of additional sensors 180, which may be located on or within any number of mechanical components of the apparatus 10. For example, as shown in FIG. 1, a CMP apparatus 100 may include first through seventh (or more) sensors 170.

The motion-related sensors 170 and the additional sensors 180 may be high-sensitivity sensors which are operable to sense high-sensitivity signals with high-resolution data, which may be analog or digital data. In some embodiments, one or more of the motion-related sensors 170 may be a vibration sensor having an accuracy equal to or less than about 10 μg. That is, the vibration sensor may be capable of sensing motions (e.g., vibrational accelerations) equal to or less than about 10 μg. In some embodiments, the motion-related sensors 170 or the additional sensors 180 may be high-resolution sensors having data that is output or converted to digital data at a resolution equal to or greater than 24 bits. In some embodiments, the additional sensors 180 include a temperature sensor having an accuracy equal to or less than 0.1° C.

As shown in FIG. 4, the irregular mechanical motion detection system 400 includes signal processing circuitry 410 and defect prediction circuitry 420.

The motion-related sensors 170 and additional sensors 180 are communicatively coupled to the signal processing circuitry 410 so that the signal processing circuitry 410 receives signals output by the motion-related sensors 170 and additional sensors 180 that are indicative of the sensed parameters of the various components of the apparatus 10, such as sensed parameters associated with the first and second mechanical components 12, 14. The motion-related sensors 170 and additional sensors 180 may be communicatively coupled to the signal processing circuitry 410 by any suitable communications network. The communications network may utilize one or more protocols to communicate via one or more physical networks, including local area networks, wireless networks, dedicated lines, intranets, the Internet, and the like.

In some embodiments, the communications network includes one or more electrical wires which communicatively couple the motion-related sensors 170 or the additional sensors 180 to the signal processing circuitry 410. For example, as shown in FIG. 4, a motion-related sensor 170 located on or within the first mechanical components 12 may be communicatively coupled to the signal processing circuitry 410 through one or more electrical wires. In some embodiments, the communications network may include a wireless communications network 401 for communicating signals from any of the motion-related sensors 170 or additional sensors 180 to the signal processing circuitry 410. For example, as shown in FIG. 4, a motion-related sensor 170 and an additional sensor 180 located on or within the second mechanical component 14 may be communicatively coupled to the signal processing circuitry 410 through a wireless network 401. The use of wireless network 401 may be particularly advantageous for sensors located on or within components of the apparatus 10 that are not easily routable through electrical wires. For example, the second mechanical component 14 may be a platen, such as the platen 110, and the motion-related sensor 170 or the additional sensor 180 may be configured to wirelessly communicate with the signal processing circuitry 410. Any of the motion-related sensors 170 and the additional sensors 180, as well as the signal processing circuitry 410, may include wireless communications circuitry which facilitates wireless communications between the motion-related sensors 170, the additional sensors 180, and the signal processing circuitry 410.

The signal processing circuitry 410 may be or include any electrical circuitry configured to perform the signal processing techniques described herein. In some embodiments, the signal processing circuitry 410 may include or be executed by a computer processor, a microprocessor, a microcontroller, or the like, configured to perform the various functions and operations described herein with respect to the signal processing circuitry. For example, the signal processing circuitry 410 may be executed by a computer processor selectively activated or reconfigured by a stored computer program, or may be a specially constructed computing platform for carrying out the features and operations described herein. In some embodiments, the signal processing circuitry 410 may be configured to execute software instructions stored in any computer-readable storage medium, including, for example, read-only memory (ROM), random access memory (RAM), flash memory, hard disk drive, optical storage device, magnetic storage device, electrically erasable programmable read-only memory (EEPROM), organic storage media, or the like.

The signal processing circuitry 410 receives and processes signals output by the motion-related sensors 170 and the additional sensors 180. In some embodiments, the signal processing circuitry 410 includes an analog-to-digital (ADC) converter 412, which converts analog signals (e.g., as may be received from the motion-related sensors 170 and the additional sensors 180) into digital signals. The digital signals, for example, as output by the ADC 412, may be processed by fast Fourier transform (FFT) circuitry 414 which transforms the sensing signals (e.g., in digital form) from the time domain into the frequency domain, applying any suitable FFT algorithm or technique. FFT algorithms for performing transformation of a signal from its original domain (e.g., the time domain) to a representation in the frequency domain are well known within the field of signal processing, and any such known FFT algorithm may be utilized by the FFT circuitry 414. Transforming signals received from any of the motion-related sensors 170 or the additional sensors 180 into the frequency domain may yield certain spikes of activity (e.g., detected motions, vibrations, etc.) at certain frequencies or within certain frequency bands. This may be the result, for example, of motions caused by various different components (e.g., a pump, a fan, a motor, a wobbling or vibration of the platen, the pad conditioner, the polishing head, or any other component), and the different motions may have different frequencies which may be separately detected and identified in the frequency domain.

The signal processing circuitry 410 may calculate or generate a frequency spectrum for each received sensing signal, for example, using the FFT circuitry 414. The frequency spectrum for each received sensing signal may be generated based on samples having a particular sampling period (e.g., period of time) in the time domain. That is, each of the signals may be analyzed as clips having some period of time, for example, 1 second, 500 ms, 10 ms, 1 ms, or less than 1 ms. Each of these clips of data sensed by the motion-related sensors 170 or additional sensors 180 may then be processed by the FFT circuitry 414 to obtain frequency spectrums for the clips.

The signal processing circuitry 410 may generate spectral images for signals received from each of the motion-related sensors 170 or additional sensors 180, and the spectral images may be generated based on the frequency spectrums output by the FFT circuitry 414 and the time domain information associated with each of the frequency spectrums (e.g., the time period for each of the clips over which the signal data is transformed to the frequency domain).

The signal processing circuitry 410 may further include window circuitry 416, which may process the outputs of the FFT circuitry 414 (e.g., frequency spectrum data associated with certain time-domain sampling clips of the sensor outputs). The window circuitry 416 may apply any window function to the frequency spectrums. As is known within the field of signal processing, a window function may be utilized in spectrum analysis, for example, to provide better resolution and distinguishability among a plurality of frequency components (e.g., vibrations or motions having different frequencies which may be apparent in the frequency spectrum generated based on the sensing signals sensed by a particular sensor).

In some embodiments, the window circuitry 416 is configured to apply a Hamming window to the frequency spectrum output by the FFT circuitry 414. The Hamming window is a known window function that is commonly used in narrow band applications. By applying a Hamming window using the window circuitry 416, particular frequency components of interest are retained in the spectral images, and the resolution and distinguishability of the frequency components of interest may be improved.

Figure 5:
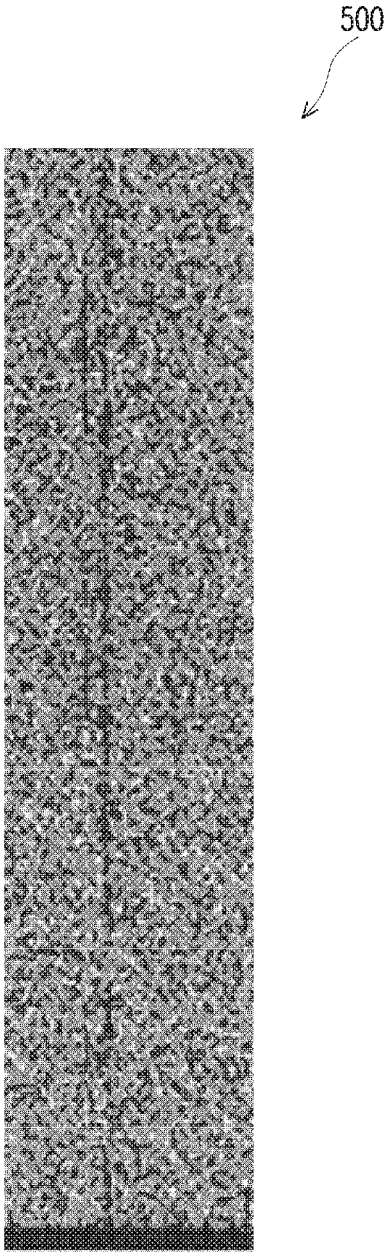
FIG. 5 is a diagram schematically illustrating a spectral image which may be generated by the signal processing circuitry of the system shown in FIG. 4, in accordance with some embodiments.

FIG. 5 is a diagram schematically illustrating a spectral image 500 which may be generated by the signal processing circuitry 410. In the spectral image 500, the x-axis may represent units of time (e.g., seconds, milliseconds, microseconds, etc.) and the y-axis may represent units of frequency (e.g., Hz). The spectral image 500 may be generated by the signal processing circuitry 410 based on sensing signals received from a particular sensor, e.g., a particular motion-related sensor 170 or a particular additional sensor 180. A separate spectral image 500 may be produced for each of the sensors in the semiconductor processing apparatus 10 (e.g., for each motion-related sensor 170 and each additional sensor 180). The spectral image 500 represents the frequency components of the sensed signals over some finite interval or sampling period, as represented by the x-axis. For example, each spectral image 500 may be representative of frequency components of a sensed signal over a period of 10 seconds, 5 seconds, 1 second, or any other suitable interval. The spectral images 500 may be generated based on a plurality of successive frequency spectrums generated by the FFT circuitry 414, each of which frequency spectrums are generated based on a shorter interval than the interval of the spectral images 500. The frequency spectrums generated by the FFT circuitry 414 are not in the time domain; instead, they represent frequencies of motions which are obtained based on the signals output by the sensors. However, the frequency spectrums are obtained sequentially, with each frequency spectrum being obtained over some sampling period or time-based interval of the sensed signals. For example, the frequency spectrums may be generated based on a clip of the sensed data having an interval of less than 1 ms, and the spectral images 500 may be generated based on a plurality of sequential frequency spectrums, each of which are generated for the sensed data based on a plurality of sequential clips. Accordingly, the spectral images 500 may have a time interval that is greater than 1 ms in the example provided.

The spectral images 500 thus visually represent the frequency spectrum of the sensed data in a temporal manner. That is, the frequency spectrum obtained at a first time (e.g., at the left side of the x-axis) may be different from the frequency spectrum obtained at a later second time (e.g., moving to the right side of the x-axis). The amplitude of the frequency components in the frequency spectrum may be represented in the spectral images 500 by any suitable indicia. For example, in the spectral image 500 illustrated in FIG. 5, the amplitude of the frequency components may be indicated by color, grayscale values or the like. For example, the dots or regions of a first color (e.g., red) in the spectral image 500 may indicate amplitude values (e.g., amplitudes of the parameter being sensed, such as vibration, acceleration, temperature, etc.) which are higher than those represented by dots or regions having other colors (e.g., green, yellow, or blue dots). In some embodiments, each of the different colors may represent a particular range of amplitude values of the frequency components. Color is provided as one example indicia that may be utilized in the spectral images to indicate relative amplitude or intensity of the frequency components; however, embodiments provided herein are not limited thereto. Any suitable indicia for representing relative amplitude or intensity of the frequency components at measured clips or intervals may be utilized in the spectral images 500.

Referring again to FIG. 4, the signal processing circuitry 410 is communicatively coupled to the defect prediction circuitry 420. The defect prediction circuitry 420 may include, or otherwise be executed by, a computer processor configured to perform the various functions and operations described herein. For example, the defect prediction circuitry 420 may be executed by a computer processor selectively activated or reconfigured by a stored computer program, or may be a specially constructed computing platform for carrying out the features and operations described herein.

In some embodiments, the defect prediction circuitry 420 includes memory which stores instructions for performing one or more of the features or operations described herein, and the defect prediction circuitry 420 may be operable to execute instructions stored, for example, in the memory to perform the functions of the defect prediction circuitry 420 described herein. The memory may be or include any computer-readable storage medium, including, for example, read-only memory (ROM), random access memory (RAM), flash memory, hard disk drive, optical storage device, magnetic storage device, electrically erasable programmable read-only memory (EEPROM), organic storage media, or the like.

The defect prediction circuitry 420 may receive spectral images 500 from the signal processing circuitry 410. The defect prediction circuitry 420 analyzes the spectral images 500 to predict or determine irregularities in motion of the various components of the semiconductor processing apparatus 10, for example, based on a comparison of the received spectral images 500 with past data or analysis of the received spectral images 500 by a machine learning model that is trained with past data (e.g., past spectral images 500) indicative of irregular motions of one or more mechanical components of the semiconductor processing apparatus 10. In some embodiments, the defect prediction circuitry 420 may further predict or determine a status or a remaining operational lifetime of one or more mechanical components of the semiconductor processing apparatus 10 based on the analysis of the spectral images 500.

In some embodiments, the defect prediction circuitry 420 may predict or determine irregular motions, status, or remaining operational lifetime of the mechanical components by employing one or more artificial intelligence or machine learning techniques, which in some embodiments may be implemented at least in part by machine learning circuitry 430. Some or all of the determinations described herein that are made by the defect prediction circuitry 420 may be performed automatically by the defect prediction circuitry 420, for example, in response to receiving spectral images 500 from the signal processing circuitry 410. The machine learning circuitry 430 may be included as part of the defect prediction circuitry 420 (as shown), or may be remotely located and communicatively coupled with the defect prediction circuitry 420. The machine learning circuitry 430 may predict or determine the irregular motions, status, or remaining operational lifetime of the mechanical components of the semiconductor processing apparatus 10 by using past data (e.g., the machine learning circuitry 430 may be trained based on past data) which indicates motions of the mechanical components that are known to be irregular (e.g., past spectral images for a mechanical component that is known to indicate irregular motions), a known status of the mechanical components and its associated irregular motions (e.g., past spectral images for a mechanical component that is known to be failing or defective), or a known remaining operational lifetime of the mechanical components and its associated motions (e.g., spectral images for a mechanical component that is known to have failed within some period of time, such as 1 month later), and the machine learning circuitry 430 may compare the received spectral images 520 with the past data to predict or determine the irregular motions, status, or remaining operational lifetime of the mechanical components based on similarities or deviations from the past data or from a trained model contained within, managed by, or otherwise accessible to the machine learning circuitry 430.

"Artificial intelligence" is used herein to broadly describe any computationally intelligent systems and methods that can learn knowledge (e.g., based on training data), and use such learned knowledge to adapt its approaches for solving one or more problems, for example, by making inferences based on a received input, such as the received spectral images. Machine learning generally refers to a sub-field or category of artificial intelligence, and is used herein to broadly describe any algorithms, mathematical models, statistical models, or the like that are implemented in one or more computer systems or circuitry, such as processing circuitry, and which build one or more models based on sample data (or training data) in order to make predictions or decisions.

The defect prediction circuitry 420 or the machine learning circuitry 430 may employ, for example, neural network, deep learning, convolutional neural network, Bayesian program learning, support vector machines, and pattern recognition techniques to solve problems such as predicting or determining irregular motions, status, or remaining operational lifetime of mechanical components of a semiconductor processing apparatus. Further, the defect prediction circuitry 420 or the machine learning circuitry 430 may implement any one or combination of the following computational algorithms or techniques: classification, regression, supervised learning, unsupervised learning, feature learning, clustering, decision trees, or the like.

As one example, an artificial neural network may be utilized by the defect prediction circuitry 420 or the machine learning circuitry 430 to develop, train, or update one or more machine learning models which may be utilized to predict or determine the irregular motions, status, or remaining operational lifetime of mechanical components. An example artificial neural network may include a plurality of interconnected "neurons" which exchange information between each other. The connections have numeric weights that can be tuned based on experience, and thus neural networks are adaptive to inputs and are capable of learning. The "neurons" may be included in a plurality of separate layers which are connected to one another, such as an input layer, a hidden layer, and an output layer. The neural network may be trained by providing training data (e.g., past data or past spectral images which are indicative of irregular motions, status, or remaining operational lifetime of the mechanical components) to the input layer. Through training, the neural network may generate and/or modify the hidden layer, which represents weighted connections mapping the training data provided at the input layer to known output information at the output layer (e.g., classification of received sensing data as representative of irregular motions, a status, or a remaining operational lifetime of the mechanical components). Relationships between neurons of the input layer, hidden layer, and output layer, formed through the training process and which may include weight connection relationships, may be stored, for example, as one or more machine learning models within or otherwise accessible to the machine learning circuitry 430.

Once the neural network has been sufficiently trained, the neural network may be provided with non-training data (e.g., new spectral images 500 received during operation of the semiconductor processing apparatus 10) at the input layer. Utilizing irregular motion knowledge (e.g., as stored in the machine learning model, and which may include, for example, weighted connection information between neurons of the neural network), the neural network may make determinations about the received spectral images 500 at the output layer. For example, the neural network may predict or determine the irregular motions, status, or remaining operational lifetime of the mechanical components.

Employing one or more computationally intelligent and/or machine learning techniques, the defect prediction circuitry 420 may learn (e.g., by developing and/or updating a machine learning algorithm or model based on training data) to predict or determine the irregular motions, status, or remaining operational lifetime of the mechanical components, and in some embodiments, the defect prediction circuitry 420 may make some predictions or determinations based at least in part on knowledge, inferences or the like developed or otherwise learned through training of the machine learning circuitry 430.

The machine learning circuitry 430 may be implemented in one or more processors having access to instructions, which may be stored in any computer-readable storage medium, which may be executed by the machine learning circuitry 430 to perform any of the operations or functions described herein.

In some embodiments, the machine learning circuitry 430 is communicatively coupled to a spectral image database 442, which may be stored, for example, in any computer-readable storage medium. The spectral image database 442 may include information that associates sensed parameters (e.g., as sensed by a motion-related sensor 170 or an additional sensor 180) with irregular motions, status, or remaining operational lifetime of the mechanical components. In some embodiments, the spectral image database 442 stores a plurality of historical (e.g., past) spectral images having known outcomes or otherwise representing a known irregular motion, status, or remaining operational lifetime of one or more mechanical components of the semiconductor processing apparatus 10.

In some embodiments, the machine learning circuitry 430 may be trained based on the historical spectral images stored in the spectral image database 442. That is, the historical spectral images may be provided as training data for training the machine learning circuitry 430, and the algorithm or machine learning model contained within or accessible to the machine learning circuitry 430 may be updated or modified based on the historical spectral images stored in the spectral image database 442, so that the trained machine learning circuitry 430 may predict or determine irregular motions, status, or remaining operational lifetime of the mechanical components.

In some embodiments, the training data (e.g., historical spectral images stored in the spectral image database 442) may be or include labeled training data from which the machine learning circuitry 430 or the defect prediction circuitry 420 may learn to predict or determine irregular motions, status, or remaining operational lifetime of the mechanical components. The labeled training data may include labels indicating that one or more of the spectral images stored in the spectral image database represents, for example, irregular motions, status, or remaining operational lifetime of the mechanical components.

During use of the semiconductor processing apparatus 10, the motion-related parameters sensed by the motion-related sensors 170 or the additional sensors 180 are processed by the signal processing circuitry to generate spectral images 500. The spectral images 500 may then be analyzed by the defect prediction circuitry 420 or the machine learning circuitry 430 to predict or determine irregular motions, status, or remaining operational lifetime of any of the mechanical components of the semiconductor processing apparatus 10. The defect prediction circuitry 420 or the machine learning circuitry 430 may analyze the received spectral images 500, for example, by comparing the received spectral images 500 with historical spectral images stored in the spectral image database 442 which are known to be associated with irregular motions or the like. In some embodiments, the defect prediction circuitry 420 or the machine learning circuitry 430 may analyze the received spectral images 500 by utilizing a trained machine learning model, such as a neural network or the like.

In some embodiments, the defect prediction circuitry 420 or the machine learning circuitry 430 may include or access a plurality of machine learning models, with each such machine learning models being trained based on sensor data of a particular type (e.g., a torque sensor, an acceleration sensor, a gyroscope, a vibration sensor, a pressure sensor, a temperature sensor, or a humidity sensor) and provided from a particular location (e.g., on or within the polishing head 130, the platen 110, the slurry dispenser 140, the pad conditioner base 151, the pad conditioner arm 152, the pad conditioner head 153, the conditioning disk 154, a motor, a pump, or any other component within the CMP apparatus 100, or any other mechanical component of any semiconductor processing apparatus).

In some embodiments, the defect prediction circuitry 420 or the machine learning circuitry 430 may analyze sensor data received from a plurality of different sensors of the semiconductor processing apparatus 10 in a combined manner. For example, spectral images 500 may be generated for sensor data received from each of a plurality of different sensors 170, 180 of the semiconductor processing apparatus 10. Each of the different spectral images 500 may be according a particular weight or coefficient value, for example, by the machine learning circuitry 430 (which may be a neural network, in some embodiments). The weighted spectral images 500 may then be combined into a single spectral image which concurrently represents the sensor data from all of the separate sensors 170, 180, and the combined spectral image may be compared with a machine-learning model to predict or determine irregular motions, status, or remaining operational lifetime of any of the mechanical components of the semiconductor processing apparatus 10.

In some embodiments, the irregular mechanical motion detection system 400 may include hold circuitry 480 which is communicatively coupled to the defect prediction circuitry 420 and the semiconductor processing apparatus 10 and is configured to automatically hold or stop one or more mechanical components (such as the first or second mechanical components 12, 14) of the semiconductor processing apparatus 10, for example, upon receiving an indication from the defect prediction circuitry 420 that the motion of the one or more mechanical components is irregular and should therefore be stopped. The hold circuitry 480 may be, for example, a controller or control circuitry which may be included within the semiconductor processing apparatus 10 or remotely located from the semiconductor processing apparatus 10, and which is configured to control operations of the semiconductor processing apparatus 10. The hold circuitry 480 may further provide a defect indication (e.g., a visual or audible indication) which may be utilized to alert maintenance personnel to inspect the predicted defective component or a wafer which is being processed by the predicted defective component.

Figure 6:
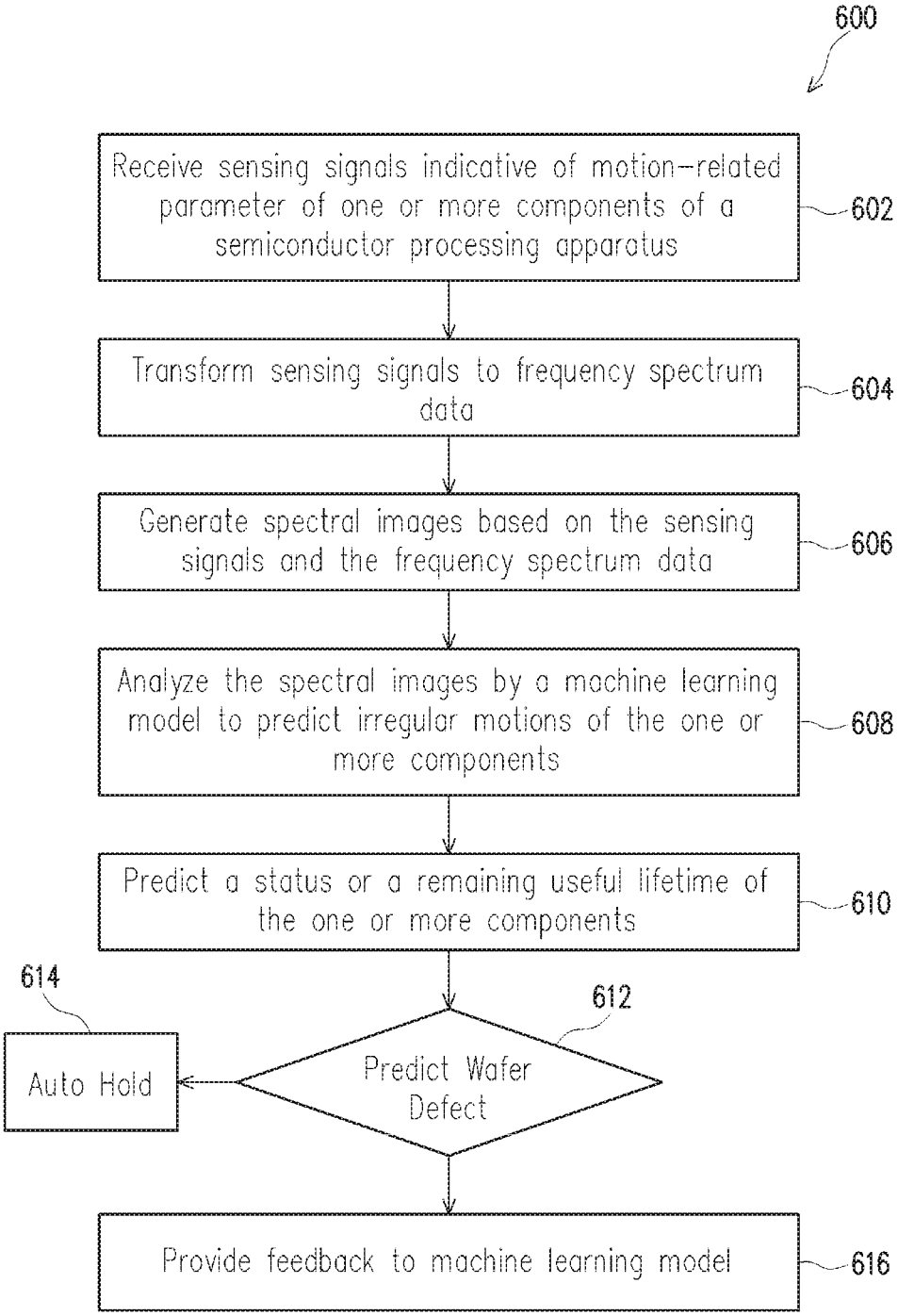
FIG. 6 is a flowchart illustrating an irregular mechanical motion prediction method, in accordance with one or more embodiments.

FIG. 6 is a flowchart 600 illustrating an irregular mechanical motion prediction method, in accordance with one or more embodiments. The irregular mechanical motion prediction method may be implemented at least in part, for example, by the CMP apparatus 100 shown in and described with respect to FIG. 1 or the irregular mechanical motion detection system 400 shown in and described with respect to FIG. 4.

At 602, the method includes receiving sensing signals indicative of motion-related parameters of one or more components of a semiconductor processing apparatus. The sensing signals may be provided, for example, from any motion-related sensor 170 which may be located on or within any mechanical component of a semiconductor processing apparatus. For example, the sensors 170 may be sensors included in the CMP apparatus 100 illustrated in FIG. 1 and may include any one or more of a first sensor 170*a* configured to sense one or more parameters associated with the polishing head 130, a second sensor 170*b* configured to sensor one or more parameters associated with the platen 110, a third sensor 170*c* configured to sense one or more parameters associated with the slurry dispenser 140, a fourth sensor 170*d* configured to sense one or more parameters associated with the pad conditioner base 151, a fifth sensor 170*e* configured to sense one or more parameters associated with the pad conditioner arm 152, a sixth sensor 170*f* configured to sense one or more parameters associated with the pad conditioner head 153, and a seventh sensor 170*g* configured to sense one or more parameters associated with the conditioning disk 154. The sensing signals may be received, for example, by the signal processing circuitry 410 of the irregular mechanical motion detection system 400.

At 604, the received sensing signals are transformed to frequency spectrum data. For example, the FFT circuitry 414, which may be included as part of the signal processing circuitry 410, may apply a FFT algorithm to transform the received sensing signals to frequency spectrum data as previously described herein. In some embodiments, the sensing signals are first converted to digital sensing signals, for example, by the analog-to-digital converter 412, and then the digital sensing signals are transformed to frequency spectrum data. In some embodiments, the signal processing circuitry 410 may apply a window function (e.g., by the window circuitry 416) as part of the transforming the sensing signals to frequency spectrum data at 604.

At 606, spectral images 500 are generated based on the received sensing signals and the frequency spectrum data. For example, the spectral images 500 may include the frequency spectrums generated by the FFT circuitry 414 and may further include time domain information associated with each of the frequency spectrums (e.g., the time period for each of the clips over which the signal data is transformed to the frequency domain). The spectral images 500 may thus provide a visual representation of the frequency spectrum data for the sensing signals in a temporal manner.

At 608, the defect prediction circuitry 420 or the machine learning circuitry 430 predicts or determines irregular motions of the one or more components of the semiconductor processing apparatus. Analyzing the spectral images to predict irregular motions at 608 may include comparing the spectral images 500 generated at 606 with one or more historical spectral images stored, for example, in the spectral image database 442. In some embodiments, machine learning models or algorithms are utilized to receive the generated spectral images 500 (e.g., as input to a neural network) and to predict irregular motions of the one or more components of the semiconductor processing apparatus (e.g., as an output of the neural network).

At 610, a status or remaining operational lifetime of the one or more components of the semiconductor processing apparatus is predicted. This may be performed, for example, by the defect prediction circuitry 420 or the machine learning circuitry 430 based on analysis of the spectral images 500, as previously described herein.

At 612, a wafer defect is predicted, for example, by the defect prediction circuitry 420 or the machine learning circuitry 430 based on analysis of the spectral images 500. The wafer may be a wafer that is currently undergoing processing by the semiconductor processing apparatus, such as a wafer undergoing CMP processing by the CMP apparatus 100. The prediction of a wafer defect at 612 may be based on the prediction of irregular motions at 708. For example, if the defect prediction circuitry 420 or machine learning circuitry 430 predicts or determines that a motion of a component of the semiconductor processing apparatus is irregular, this may indicate a defective operation of that component. The defective operation of the component thus makes it likely that the processed wafer will also have a defect as a result of the defective operation of the component. As an example, the defect prediction circuitry 420 or machine learning circuitry 430 may determine, based on the signals received from a sensor 170*f* positioned on the pad conditioner head 153, that the motion of the conditioning disk 154 is irregular or abnormal (e.g., defective operation). The irregular motion of the conditioning disk 154 may cause an edge profile of the semiconductor wafer to be thinner than it should be due to an overpolish condition. Accordingly, the defect prediction circuitry 420 or machine learning circuitry 430 may predict or determine the presence of a defect in the semiconductor wafer based on the predicted or determined defect of the component of the semiconductor processing apparatus.

If a wafer defect is predicted at 612, then in some embodiments, the method may include automatically holding or stopping one or more components of the semiconductor processing apparatus at 614. For example, hold circuitry 480 may receive an indication of a defective condition or of the prediction of a wafer defect from the defect prediction circuitry 420, and the hold circuitry 480 may control one or more components of the semiconductor processing apparatus, thereby holding or stopping the one or more components.

At 616, feedback is provided to the machine learning circuitry 430, such as a machine learning model which may be included as part of or otherwise is accessible to the machine learning circuitry 430. The feedback may be used, for example, as training data to further train the machine learning model. The feedback may indicate, for example, that a particular generated spectral image indicates irregular motions (e.g., based on the prediction at 608), a particular status (e.g., a status of normal, abnormal, based on the prediction at 610), or a remaining useful lifetime (e.g., will likely fail within one month, one week, one day, etc., based on the prediction at 610) of the one or more components of the semiconductor processing apparatus. The spectral image, as well as a result of the predictions at 608 or 610 may be provided together as training data, and may be stored in the spectral image database 442, for further training the machine learning circuitry 430 or machine learning model.

Embodiments of the present disclosure provide several advantages, and provide technical solutions to technical problems that are present, for example, within the field of semiconductor processing apparatuses, systems, and methods. For example, embodiments of the disclosure are operable to predict or determine irregular motions of one or more mechanical components of a semiconductor processing apparatus. This provides a significant advantage over conventional systems in which such irregular motions cannot be predicted, which results in failures and can lead to scrapping of the semiconductor wafer. This results in increased costs and reduced profits. Moreover, some defects which may be formed in semiconductor devices formed from a wafer that has undergone processing by the apparatus may not be detected in some cases until various additional processes have been performed. This results in further losses in terms of costs and time expended performing the additional processes on a defective wafer. However, embodiments of the present disclosure can avoid or reduce such losses by predicting the irregular motions of one or more components of the semiconductor processing apparatus, and the operation of the apparatus can be stopped to avoid damage to the wafer.

Embodiments of the present disclosure further facilitate significant improvements over conventional semiconductor processing systems, apparatuses, and methods as some embodiments of the present disclosure are capable of predicting a status (e.g., beginning to breakdown, but not yet outside of a particular tolerance range) or a remaining operational lifetime (e.g., will likely fail within one month, one week, one day, etc.) of the components of a semiconductor processing apparatus. This allows defects to be avoided, for example, by enabling maintenance personnel or the like to monitor the status of the components, and to repair the components before reaching a state at which the irregular motions of the components will damage the wafer.

According to one embodiment, a mechanical motion irregularity prediction system includes one or more motion sensors that are configured to sense motion-related parameters associated with at least one mechanical component of a semiconductor processing apparatus. The one or more motion sensors output sensing signals based on the sensed motion-related parameters. The mechanical motion irregularity prediction system further includes defect prediction circuitry that is configured to predict an irregular motion of the at least one mechanical component based on the sensing signals According to another embodiment, a method is provided that includes sensing, by at least one motion sensor, motion-related parameters associated with at least one mechanical component of a semiconductor processing apparatus. Spectral information is generated by signal processing circuitry, and the spectral information is generated based on the sensing signals. Defect prediction circuitry predicts an irregular motion of the at least one mechanical component based on the spectral information.

According to yet another embodiment, a chemical-mechanical polishing (CMP) apparatus is provided that includes a rotatable platen, a polishing pad on the rotatable platen, a polishing head, a pad conditioner, a first motion sensor, and defect prediction circuitry. The polishing head is configured to carry a semiconductor wafer and to selectively cause the semiconductor wafer to contact the polishing pad. The pad conditioner includes a pad conditioner head and a conditioning disk coupled to the pad conditioner head, and the conditioning disk is configured to selectively contact the polishing pad. The first motion sensor is configured to sense a first motion-related parameter associated with at least one of the rotatable platen, the polishing pad, the polishing head, or the pad conditioner. The defect prediction circuitry is configured to predict an irregular motion of the at least one of the rotatable platen, the polishing pad, the polishing head, or the pad conditioner based on the sensed first motion-related parameter.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A mechanical motion irregularity prediction system, comprising:

one or more sensors configured to sense one or more parameters associated with a motion of at least one mechanical component of a semiconductor processing apparatus, and configured to output one or more sensing signals based on the one or more parameters sensed by the one or more sensors; and defect prediction circuitry configured to predict an irregular motion of the at least one mechanical component based on the one or more sensing signals, and wherein the irregular motion of the at least one mechanical component being irregular relative to a normal operation motion of the at least one mechanical component.

2. The system of claim 1, further comprising:

a database communicatively coupled to the defect prediction circuitry, the database storing information associated with irregular motion of the at least one mechanical component, wherein the defect prediction circuitry is configured to predict the irregular motion of the at least one mechanical component based on the sensing signals and the information stored in the database.

3. The system of claim 1, further comprising:

signal processing circuitry communicatively coupled to the one or more motion sensors and to the defect prediction circuitry, the signal processing circuitry configured to:

receive the sensing signals output from the one or more motion sensors;

generate spectral images based on the sensing signals, the spectral images including frequency and time information associated with the sensing signals.

4. The system of claim 3 wherein the signal processing circuitry includes an analog-to-digital converter configured to convert the received sensing signals into digital sensing signals.

5. The system of claim 4 wherein the signal processing circuitry further includes fast Fourier transform (FFT) circuitry configured to transform the digital sensing signals to frequency spectrum data.

6. The system of claim 5 wherein the signal processing circuitry further includes window circuitry configured to generate apply a window function to the frequency spectrum data.

7. The system of claim 3, further comprising:

a historical spectral image database which stores a plurality of historical spectral images that are indicative of irregular motion of the at least one mechanical component, wherein the defect prediction circuitry is configured to predict the irregular motion of the at least one mechanical component based on the spectral images and the historical spectral images.

8. The system of claim 1 wherein the defect prediction circuitry is further configured to predict at least one of a status or a remaining operational lifetime of the at least one mechanical component based on the sensing signals.

9. The system of claim 1, further comprising:

hold circuitry communicatively coupled to the defect prediction circuitry and the at least one mechanical component of the semiconductor wafer processing apparatus, the hold circuitry configured to stop an operation of the at least on mechanical component in response to the defect prediction circuitry predicting the irregular motion of the at least one mechanical component.

10. A method, comprising:

sensing, by at least one sensor, at least one parameter associated with a motion of at least one mechanical component of a semiconductor processing apparatus;

outputting, by the at least one sensor, at least one sensing signal based on the at least one parameter sensed by the at least one sensor;

generating, by signal processing circuitry, spectral information based on the at least one sensing signal; and predicting, by defect prediction circuitry, an irregular motion of the at least one mechanical component based on the spectral information, and wherein the irregular motion is irregular to or different from a normal operation motion of the at least one mechanical component.

11. The method of claim 10 wherein the generating the spectral information includes:

converting the sensing signals into digital sensing signals;

transforming the digital sensing signals to frequency spectrum data; and applying a window function to the frequency spectrum data.

12. The method of claim 10 wherein the generating the spectral information includes generating spectral images, the spectral images including frequency and time information associated with the sensing signals.

13. The method of claim 12 wherein the predicting an irregular motion of the at least one mechanical component includes analyzing the generated spectral images by machine learning circuitry trained to predict the irregular motion based on a plurality of historical spectral images that are indicative of irregular motion of the at least one mechanical component.

14. The method of claim 10, further comprising:

automatically stopping an operation of the at least one mechanical component based on the predicting the irregular motion of the at least one mechanical component.

15. A chemical-mechanical polishing (CMP) apparatus, comprising:

a rotatable platen;

a polishing pad on the rotatable platen;

a polishing head configured to carry a semiconductor wafer and to selectively cause the semiconductor wafer to contact the polishing pad;

a pad conditioner having a pad conditioner head and a conditioning disk coupled to the pad conditioner head, the conditioning disk configured to selectively contact the polishing pad;

a first sensor configured to sense a first parameter associated with a motion of at least one of the following of the rotatable platen, the polishing pad, the polishing head, and the pad conditioner; and defect prediction circuitry configured to predict an irregular motion of the at least one of the following of the rotatable platen, the polishing pad, the polishing head, and the pad conditioner based on the first parameter sensed by the first sensor, and wherein the irregular motion of at least one of the following of the rotatable platen, the polishing pad, the polishing head, and the pad conditioner is irregular relative to or different from a corresponding normal operation motion of at least one of the following of the rotatable platen, the polishing pad, the polishing head, and the pad conditioner.

16. The CMP apparatus of claim 15, further comprising:

signal processing circuitry communicatively coupled to the first sensor and to the defect prediction circuitry, the signal processing circuitry configured to generate spectral images based on the first parameter sensed by the first sensor, the spectral images including frequency and time information associated with the first parameter sensed by the first sensor.

17. The CMP apparatus of claim 15, further comprising:

hold circuitry communicatively coupled to the defect prediction circuitry and to at least one of the following of the rotatable platen, the polishing pad, the polishing head, and the pad conditioner, the hold circuitry configured to stop an operation of at least one of the following of the rotatable platen, the polishing pad, the polishing head, and the pad conditioner in response to the defect prediction circuitry predicting the irregular motion.

18. The CMP apparatus of claim 15 wherein the first sensor includes at least one of the following of a torque sensor, an acceleration sensor, a gyroscope, and a vibration sensor.

19. The CMP apparatus of claim 18, further comprising:

a second sensor configured to sense a second parameter associated with a motion of at least one of the following of the rotatable platen, the polishing pad, the polishing head, and the pad conditioner, the second sensor including at least one of the following of a pressure sensor, a temperature sensor, and a humidity sensor, wherein the defect prediction circuitry is configured to predict the irregular motion of at least one of the following of the rotatable platen, the polishing pad, the polishing head, and the pad conditioner based on the first parameter sensed by the first sensor and the second parameter sensed by the second sensor.

20. The CMP apparatus of claim 15 wherein the defect prediction circuitry is configured to predict at least one of the following of a status and a remaining operational lifetime of the at least one of the rotatable platen, the polishing pad, the polishing head, or the pad conditioner based on the sensed first parameter.

* * * * *